US008347967B2

(12) United States Patent
Mathis

(10) Patent No.: US 8,347,967 B2
(45) Date of Patent: Jan. 8, 2013

(54) SUBSEA TREE SAFETY CONTROL SYSTEM

(75) Inventor: David J. Mathis, Lake Charles, LA (US)

(73) Assignee: Sclumberger Technology Corporation, Sugar Land, TX (US)

( * ) Notice: Subject to any disclaimer, the term of this patent is extended or adjusted under 35 U.S.C. 154(b) by 539 days.

(21) Appl. No.: 12/425,694

(22) Filed: Apr. 17, 2009

(65) Prior Publication Data

US 2009/0260829 A1 Oct. 22, 2009

Related U.S. Application Data

(60) Provisional application No. 61/046,198, filed on Apr. 18, 2008.

(51) Int. Cl.
*E21B 34/04* (2006.01)

(52) U.S. Cl. ... 166/368; 166/336; 166/352; 166/250.01; 166/373; 251/129.01

(58) Field of Classification Search ..... 166/368, 166/336, 352, 363, 364, 250.01, 373, 66.6, 166/316; 251/129.01, 129.04
See application file for complete search history.

(56) References Cited

U.S. PATENT DOCUMENTS

| | | | | |
|---|---|---|---|---|
| 4,276,640 | A | 6/1981 | McNamee et al. | |
| 4,636,934 | A * | 1/1987 | Schwendemann et al. | 700/3 |
| 4,658,904 | A * | 4/1987 | Doremus et al. | 166/336 |
| 4,679,766 | A * | 7/1987 | Cuming | 251/129.04 |
| 4,685,521 | A * | 8/1987 | Raulins | 166/341 |
| 4,798,247 | A * | 1/1989 | Deaton et al. | 166/66.7 |
| 4,880,060 | A * | 11/1989 | Schwendemann et al. | 166/336 |
| 5,293,551 | A * | 3/1994 | Perkins et al. | 361/154 |
| 5,539,375 | A * | 7/1996 | Atherton | 340/538.11 |
| 5,632,468 | A * | 5/1997 | Schoenmeyr | 251/129.15 |
| 5,771,974 | A * | 6/1998 | Stewart et al. | 166/336 |
| 5,784,245 | A * | 7/1998 | Moraghan et al. | 361/154 |
| 5,803,711 | A * | 9/1998 | Schoenmeyr | 417/36 |
| 5,808,471 | A * | 9/1998 | Rooke et al. | 324/546 |
| 5,995,020 | A * | 11/1999 | Owens et al. | 340/854.9 |
| 6,111,514 | A * | 8/2000 | Cossins et al. | 340/654 |
| 6,125,938 | A * | 10/2000 | Garcia-Soule et al. | 166/344 |
| 6,227,301 | B1 | 5/2001 | Edwards et al. | |
| 6,293,344 | B1 * | 9/2001 | Nixon et al. | 166/363 |

(Continued)

FOREIGN PATENT DOCUMENTS

| | | |
|---|---|---|
| EP | 204619 | 12/1990 |

(Continued)

OTHER PUBLICATIONS

International Search Report and Written Opinion of PCT Application No. PCT/US2009/040945 dated Jun. 10, 2009: pp. 1-9.

*Primary Examiner* — Matthew Buck
(74) *Attorney, Agent, or Firm* — Chad Sullivan; Rodney Warfford; Matt Abrell

(57) ABSTRACT

An embodiment of a method for limiting the probability of failure on demand of a subsea test tree ("SSTT") includes the steps of providing a safety shut-in system for actuating a safety valve of the SSTT, the safety shut-in system including a surface control station positioned above a water surface connected via an umbilical to a subsea control system positioned below the water surface to actuate the safety valve; and diagnostically testing the safety shut-in system without actuating the safety valve.

20 Claims, 3 Drawing Sheets

U.S. PATENT DOCUMENTS

| | | | | |
|---|---|---|---|---|
| 6,307,376 | B1 * | 10/2001 | Alexander et al. | 324/388 |
| 6,330,913 | B1 | 12/2001 | Langseth | |
| 6,343,654 | B1 * | 2/2002 | Brammer | 166/338 |
| 6,357,525 | B1 | 3/2002 | Langseth | |
| 7,086,467 | B2 * | 8/2006 | Schlegelmilch et al. | 166/298 |
| RE39,583 | E | 4/2007 | Upchurch | |
| 7,225,873 | B2 * | 6/2007 | Schlegelmilch et al. | 166/298 |
| 7,261,162 | B2 * | 8/2007 | Deans et al. | 166/336 |
| 7,446,541 | B2 * | 11/2008 | Xiao et al. | 324/537 |
| 7,464,721 | B2 | 12/2008 | Perry et al. | |
| 7,628,207 | B2 * | 12/2009 | Leonardi et al. | 166/364 |
| 7,823,640 | B2 * | 11/2010 | Flanders | 166/250.01 |
| 2004/0262008 | A1 | 12/2004 | Deans | |
| 2005/0274417 | A1 | 12/2005 | Perry et al. | |
| 2006/0254773 | A1 | 11/2006 | Schlegelmilch | |
| 2007/0204998 | A1 | 9/2007 | Rytlewski | |
| 2008/0105436 | A1 | 5/2008 | Molina | |
| 2009/0107682 | A1 * | 4/2009 | Davis | 166/336 |
| 2009/0229830 | A1 | 9/2009 | Kerr | |
| 2009/0260829 | A1 | 10/2009 | Mathis | |
| 2010/0012327 | A1 | 1/2010 | Leonardi | |

FOREIGN PATENT DOCUMENTS

| | | | |
|---|---|---|---|
| GB | 2294962 | | 5/1996 |
| GB | 2299868 | A | 10/1996 |
| GB | 2335215 | A | 9/1999 |
| GB | 2340156 | | 2/2000 |
| GB | 2378724 | | 2/2003 |
| GB | 2402409 | | 12/2004 |
| GB | 2406238 | | 3/2005 |
| GB | 2423207 | | 8/2006 |
| GB | 2435665 | | 9/2007 |
| WO | 2000065200 | | 11/2000 |
| WO | 2005098198 | A1 | 10/2005 |
| WO | 2008057654 | | 10/2008 |
| WO | 2009114445 | | 9/2009 |
| WO | 2009146206 | | 12/2009 |

* cited by examiner

SUBSEA TREE SAFETY CONTROL SYSTEM

RELATED APPLICATIONS

This application claims the benefit of U.S. Provisional Patent Application No. 61/046,198 filed Apr. 18, 2008.

TECHNICAL FIELD

The present application relates in general to wellbore operations and in particular to subsea riser and the associated safety equipment and methods.

BACKGROUND

Offshore systems (e.g., in lakes, bays, seas, oceans etc.) often include a riser which connects a surface vessel's equipment to a blowout preventer stack on a subsea wellhead. Offshore systems which are employed for well testing operations also typically include a safety shut-in system which automatically prevents fluid communication between the well and the surface vessel in the event of an emergency, such as when conditions in the well deviate from preset limits. Typically, the safety shut-in system includes a subsea test tree which is landed inside the blowout preventer stack on a pipe string. The subsea test tree generally includes a valve portion which has one or more safety valves that can automatically shut-in the well via a subsea safety shut-in system. Traditionally subsea safety shut-in systems provide that safety valves fail as-is in case of electric power failure for example. The traditional subsea safety shut-in systems further comprise systems and methods that may not provide a desired probability of failure on demand level. It is a desire to provide a system and method for providing a desired level of failure on demand.

SUMMARY

An embodiment of a subsurface test tree system includes a subsea test tree having a safety valve, the subsea test tree connectable with a blowout preventer stack below a water surface; a subsea control system operationally connected with the subsea test tree below the water surface to actuate the safety valve, wherein the subsea control system does not include a microprocessor; a surface control station positioned at a surface location, the control station including a microprocessor; and an umbilical operationally connecting the control station and the subsea control system to actuate the safety valve in response to a signal sent from the control station to the subsea control system.

The subsea control system may demultiplex the signal received from the surface control station. The surface control system may utilize DC actuation to actuate the safety valve. The control station may provide an electric current through a conductor in the umbilical to actuate the safety valve via the subsea control system. The subsea control system may include a diode steering circuit to demultiplex an electric current received from the surface control station. The umbilical includes only seven conductors to operationally connect the surface control station and the subsea control system in one embodiment.

An embodiment of a method for operating a subsea test tree ("SSTT") that has a safety valve includes the steps of providing a subsea control system below a water surface in connection with the safety valve; connecting a surface control station to the subsea control system via an umbilical; and actuating the safety valve via DC actuation.

The step of actuating the safety valve via DC actuation may include the steps of transmitting an electric current from the surface control station through the umbilical to the subsea control system; and demultiplexing the electric current below the water surface. The subsea control system may include a diode steering circuit for demultiplexing the electric current.

The subsea control system does not include a microprocessor in some embodiments. The subsea control system may include a diode steering circuit.

The method may include a step of diagnostically testing the SSTT without actuating the safety valve. The method may include a step of diagnostically testing the SSTT which may include transmitting an electric current to the subsea control system that it insufficient to actuate the safety valve; calculating the implied impedance to the electric current; and determining if a fault mode of SSTT has occurred.

The method may include a step of providing backup electric power to the subsea control system to maintain the safety valve in an as-is state upon loss of a primary source of electric power to the subsea control system. The method may include the step of actuating the safety valve to a safe state upon the passage of a selected time-delay after loss of the primary source of electric power.

An embodiment of a method for limiting the probability of failure on demand of a subsea test tree ("SSTT") includes the steps of providing a safety shut-in system for actuating a safety valve of the SSTT, the safety shut-in system including a surface control station positioned above a water surface connected via an umbilical to a subsea control system positioned below the water surface to actuate the safety valve; and diagnostically testing the safety shut-in system without actuating the safety valve.

The method may include the step of actuating the safety valve via DC actuation. The step of diagnostically testing may include the steps of transmitting an electric current to the subsea control system that it insufficient to actuate the safety valve; calculating the implied impedance to the electric current; and determining if a fault mode of SSTT has occurred.

The method may include the step of actuating the safety valve via DC actuation. The method may include the step of maintaining the safety valve in an as-is position for a selected time delay upon electric failure of the safety shut-in system. The method may include the step of actuating the safety valve to a safe state upon passage of the selected time delay.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of present embodiments will be best understood with reference to the following detailed description of a specific embodiment of the invention, when read in conjunction with the accompanying drawings, wherein.

DETAILED DESCRIPTION

Figure 1:
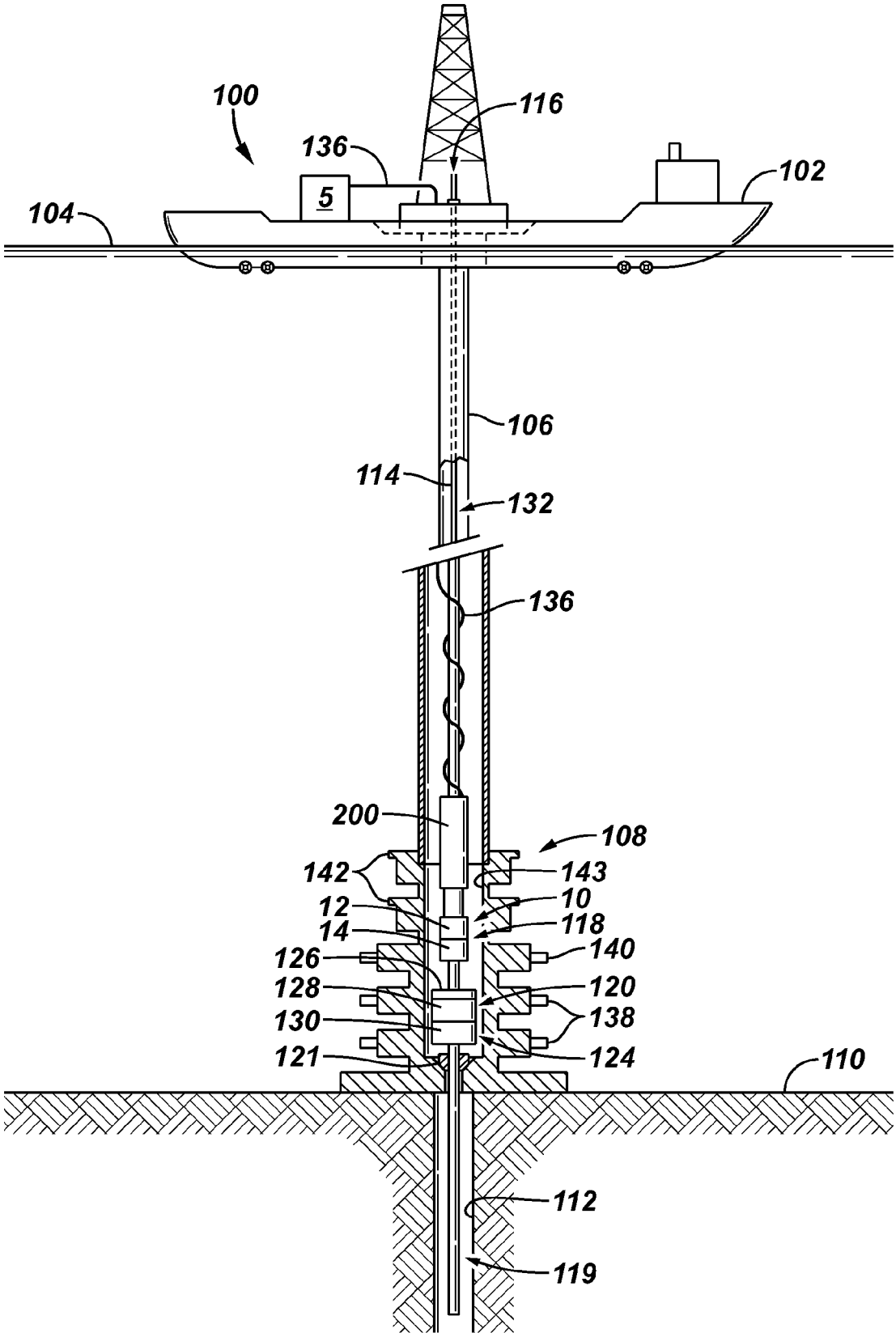
FIG. 1 is a schematic view of a subsea well system and safety system in accordance with an embodiment of the invention.

Refer now to the drawings wherein depicted elements are not necessarily shown to scale and wherein like or similar elements are designated by the same reference numeral through the several views.

FIG. 1 illustrates a subsea production well testing system 100 which may be employed to test production characteristics of a well. Subsea production well testing system 100 includes a vessel 102 which is positioned on a water surface 104 and a riser 106 which connects vessel 102 to a blowout preventer ("BOP") stack 108 on seafloor 110. A well 112 has been drilled into seafloor 110, and a tubing string 114 extends from vessel 102 through blowout preventer stack 108 into well 112. Tubing string 114 is provided with a bore 116 through which hydrocarbons or other formation fluids can be conducted from well 112 to the surface during production testing of the well. A test device, such as a pressure/temperature sub, may be provided in tubing string 114 to monitor the flow of formation fluids into tubing string 114.

Well testing system 100 includes a safety shut-in system 118 which provides automatic shut-in of well 112 when conditions on vessel 102 or in well 112 deviate from preset limits. Safety shut-in system 118 includes a subsea tree 120 (e.g., subsea test tree, "SSTT"), a subsea tree control system 10, a topside master control station 5 and various subsea safety valves ("SV") such as, and without limitation, retainer valve 200, valve assembly 124, and one or more blowout preventer stack rams.

Subsea tree 120 is landed in blowout preventer stack 108 on tubing string 114. A lower portion 119 of tubing string 114 is supported by a fluted hanger 121. Subsea tree 120 has a valve assembly 124 and a latch 126. Valve assembly 124 may act as a master control valve during testing of well 112. Valve assembly 124 may include safety valves, such as flapper valve 128 and a ball valve 130. Flapper valve 128 and ball valve 130 may be operated in series. Latch 126 allows an upper portion 132 of tubing string 114 to be disconnected from subsea tree 120 if desired. It should be clear that the embodiments are not limited to the particular embodiment of subsea tree 120 shown, but any other valve system that controls flow of formation fluids through tubing string 114 may also be used.

The retainer valve 200 is arranged at the lower end of upper portion 132 of tubing string 114 to prevent fluid in upper portion 132 of the tubing string from draining into riser 106 when disconnected from subsea tree 120. The retainer valve 200 also allows fluid from riser 106 to flow into upper portion 132 of tubing string 114 so that hydrostatic pressure in upper portion 132 of tubing string 114 is balanced with the hydrostatic pressure in riser 106. An umbilical 136 provides the fluid pressure necessary to operate valve portion 124, latch 126, and retainer valve 200.

Umbilical 136 includes conductors connecting a topside master control station 5 to subsea tree control system 10. In the illustrated embodiment, subsea tree control system 10 is a modular unit that includes a subsea electronics module ("SEM") 12 and a hydraulic valve and manifold pod 14. Subsea tree control system 10 may include other elements such as hydraulic accumulators, electric power sources and the like. Subsea control system 10 is positioned below water surface 104 and proximate to tree 120 in this embodiment. Umbilical 136 may be operationally connected to surface sources of power (e.g., electrical, hydraulic) in addition to electronics, communications, and power that may be provided via topside master control station 5. Subsea tree control safety system 10 may be positioned in various positions within riser 106. An example of a subsea tree that may be utilized with subsea control system 10 is disclosed in U.S. Pat. No. 6,293,344 which is incorporated herein for its teachings.

Subsea tree 120 is shown landed in subsea blowout preventer stack 108 on tubing string 114. Safety Valves 128 and 130 in subsea tree 120 and retainer valve 200 are open to allow fluid flow from lower portion 119 of tubing string 114 to upper portion 132 of tubing string 114. In the event of an emergency, safety valves 128 and 130 can be automatically closed to prevent fluid from flowing from lower portion 119 of tubing string 114 to upper portion 132 of tubing string 114. Once valves 128 and 130 are closed, upper portion 132 of tubing string 114 may be disconnected from subsea tree 120 and retrieved to vessel 102 or raised to a level which will permit vessel 102 to be moved in some instances. Although vessel 102 is illustrated as a ship, vessel 102 may include any platform suitable for wellbore drilling, production, or injection operations.

Before disconnecting upper portion 132 of tubing string 114 from subsea tree 120, retainer valve 200 is closed. The closed retainer valve 200 prevents fluid from being dumped out of upper portion 132 of tubing string 114 when upper portion 132 of tubing string 114 is disconnected from subsea tree 120. When retainer valve 200 is closed, pressure is trapped between retainer valve 200 and valve portion 124 of subsea tree 120. A bleed-off valve may be operated to bleed the trapped pressure in a controlled manner. After bleeding the trapped pressure, latch 126 may be operated to disconnect upper portion 132 of tubing string 114 from subsea tree 120.

The blowout preventer stack 108 includes pipe ram seals 138 and shear ram seal 140. However, other combinations of ram seals may be used. A lower marine riser package may be mounted between blowout preventer stack 108 and riser 106 and may include annular preventer seals 142. The lower marine riser package also typically includes control modules (not shown) for operating annular preventer seals 142, ram seals 138 and 140 in blowout preventer stack 108, and other controls as needed. The typical modules and controls may be replaced by subsea control system 10 in some embodiments. Ram seals 138 and 140 and annular preventer seals 142 define a passage 143 for receiving tubing string 114. Subsea tree 120 is arranged within blowout preventer stack 108, and retainer valve 200 extends from subsea tree 120 into annular preventers 142.

Safety shut-in system 118 and subsea control system 10 is a novel control system adapted for controlling subsea tree 120 and to address the desire to provide a low probability of failure on demand. According to some embodiments, safety shut-in system 118 provides one or more of reduction of electronics positioned subsea; diagnostic testing capabilities; and electronic fail safe systems.

Subsea safety shut-in system 118 reduces and/or eliminates the active subsea electronics utilized in typical subsea safety systems. In the illustrated embodiment of FIG. 1, the relevant electronics, such as and without limitation, voltage regulators, microcontrollers, transistors, and other active electronic systems which are typically positioned below the water surface and commonly proximate to tree 120 are positioned at the surface (e.g., above the water surface) at topside master control system 5 in the embodiment of FIG. 1.

Umbilical 136 is often required to extend to great length, for example 12,500 feet (3,810 m) or more. Umbilical 136 includes one or more conductors for transmitting signals for the surface to the subsea control system. In prior safety shut-in systems a relatively complex surface modulation and subsea demodulation method that requires subsea microprocessors to decode the signal for a desired function and a power circuit to deliver the actuation current to the desired solenoid is required.

Safety shut-in system 118 and subsea control system 10 utilize DC actuation through a multiplex/demultiplex algorithm in some embodiments to actuate the subsea functions (e.g., opening and closing of safety valves, rams, operating latches, etc.). Utilizing DC actuation, the microprocessor and associated electronic packages and devices commonly positioned subsea are moved from subsea control system 10 to the surface, for example at topside master control station 5. By positioning active electronics at topside master control station 5, as opposed to subsea at control system module 10, the electronic components may be repaired and/or replaced in a minimal period of time, thus reducing the time that safety shut-in system 118 would be unavailable compared to if the failed electronic component was positioned subsea.

Figure 2:
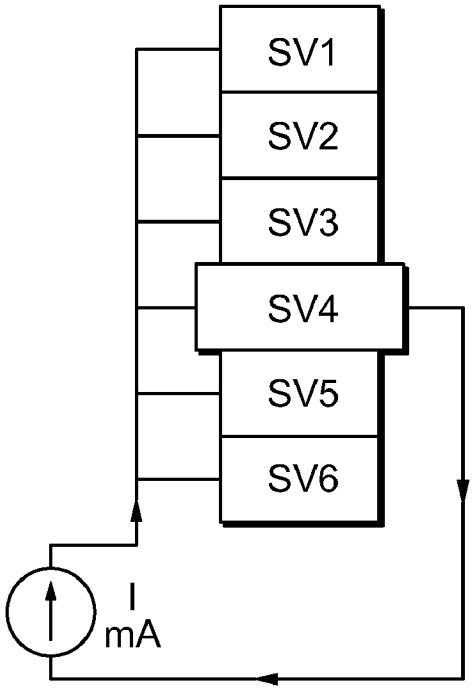
FIG. 2 is a schematic illustration of a DC actuation method and system in accordance with an embodiment of the invention.

Refer now to FIG. 2, wherein a schematic of safety shut-in system 118 is illustrated for purposes of describing DC actuation. If a current (e.g., from master control station 5) is provided through one of the multiple conductors used for safety functions in umbilical 136 and the current returns on any of the remaining conductors, then a single solenoid function can be actuated. The schematic of FIG. 2 is representative a single conductor bank.

DC actuation traditionally requires an unfeasibly high number of conductors for a long umbilical 136. However, it has been determined that through the pushing and pulling of current through a combination of conductors, as described with reference to FIG. 2, that a number of different solenoids and thus safety functions may be actuated for a limited number of conductors.

For example, if an electrical current is provided down any of seven conductors provided by umbilical 136, and then allowed to return on any one of the remaining conductors, then a single solenoid function can be actuated. By this "pushing" and "pulling" of current through any combination of the seven conductors, up to 42 different solenoids can be actuated without the use of subsea positioned microcontrollers. In some embodiments the demultiplexing is performed subsea through the use of a circuit of steering diodes, for example at subsea electronics module 12. The diodes have a very low failure rate, thus yielding a very high reliability for any given function.

Figure 3:
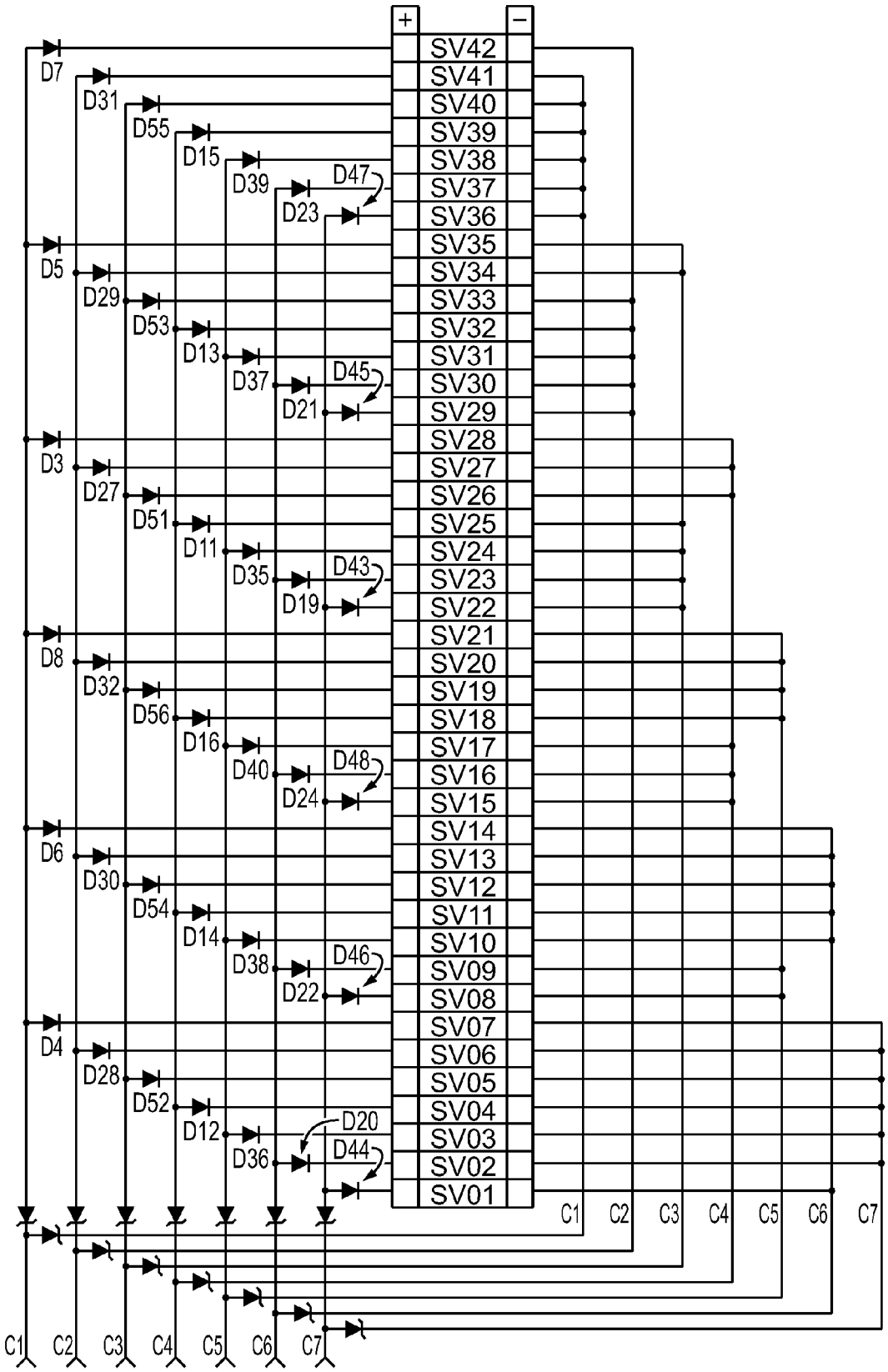
FIG. 3 is a circuit schematic of a diode steering system in accordance with and embodiment of the invention.

In an embodiment described with reference to FIG. 3, seven conductors (e.g., C1, C2, C3, C4, etc.) provide actuation to 42 unique solenoids and the solenoid valves (e.g., SV1, SV2, etc.) via DC current. If more subsea solenoid functions are required, for "N" number of lines, a number of functions equal to [N*(N−1)] may be employed. FIG. 3 is a schematic of a subsea steering diode matrix for a seven conductor (N=7) umbilical 136, thus comprising seven banks schematically illustrated in FIG. 2. Subsea steering circuit of FIG. 3 may be included in subsea electronics module 12 of subsea control system 10 illustrated in FIG. 1. Further, the solenoids may be positioned at valve and manifold pod 14 of subsea control system 10 illustrated in FIG. 1.

In SEM 12 of subsea control system 10 a series of steering diodes channel the current through the banks activating the desired solenoid valve (e.g., SV1, SV2, etc.). Blocking diodes prevent current from backing through a solenoid and activating an unintended solenoid. Squelching zener diodes may be included to prevent stray voltage from appearing on unintended lines in the event of a shorted solenoid.

The illustrated circuit employs only three diodes along the critical path of a solenoid function. This is a far more simplistic approach than any other modulation/demodulation methodology and thus yields more reliability and a lower probability of failure on demand. Additionally, all relevant complex switching components for this embodiment of the circuit of safety shut-in system 118 are located at topside control station 5 and can be quickly changed when a failure is detected thus decreasing unavailability.

Safety shut-in system 118 further facilitates a system and method for diagnostic testing of system 118 to reduce the probability of failure on demand. In many industrial installations, "partial stroke testing" is utilized to confirm operation of the systems valves. For example, in a typical safety system along a pipeline, there will be a ball-valve to facilitate emergency shut-in. During a partial stroke test, if this ball valve can be closed 10%, then many of the failure modes that could have occurred over time have been verified. This would include the presence of hydraulic accumulation to close the valve, the circuits that respond to the command to close the valve, the drive mechanisms that close the valve, etc. So immediately after the partial stroke test, the effective probability of failure on demand is lower than before the test since all of these previously unknown variables have been diagnosed.

In the case of subsea safety shut-in controls (e.g., subsea tree controls) a true "partial stroke" test can not be performed because the actuation of a subsea solenoid valve (e.g., valves 128, 130, etc.) related to a specific function will completely actuate the function. Thus, partial stroke diagnostic tests may shut-in the well and/or cut or damage a portion of the production string.

Safety shut-in system 118 utilizes a diagnostic current that is too weak to actuate a function to confirm operation of safety devices of system 118. For example, a current that is too weak to actuate a safety function is sent through the signal path (e.g., a conductor) and implied impedance is calculated. Through this measurement, a processor, such as a microcontroller, of topside master control station 5 may determine and confirm that several of the possible failure modes that may occur over time have not occurred. Although this trickle current is insufficient to trigger a solenoid into actuation, it may verify the integrity of the signal path, confirm that the uninterruptible power source (e.g., topside master control station 5) is delivering power; that a solenoid driver power supply unit is functioning; that topside master control station 5 input/output, logic solver software and circuits and multiplexing switch gear are performing; all electronic connectors are intact; or that a subsea solenoid (e.g., pod 14) has not failed in an open or shorted position.

Once the possible failure modes are verified as functional, an overall probability of failure on demand ("PFD") as a function of time is lowered. The lowered PFD average may then be calculated as the desired safety integrity level ("SIL"). Definitions of probability of failure on demand and on safety integrity level may include those definitions as provided by the International Electrotechnical Commission.

The diagnostic method and system of safety shut-in system 118 eliminates several potential failure modes that as a function of time can increase the probability of failure on demand of the system. Each time the diagnostic test is run, the overall PFD average is reduced, but never as low as the previous time interval (T). After system 118 has a PFD that increases beyond an acceptable level; system 118 may be evaluated and renewed so that the PFD is reduced to an acceptable level.

Figure 4:
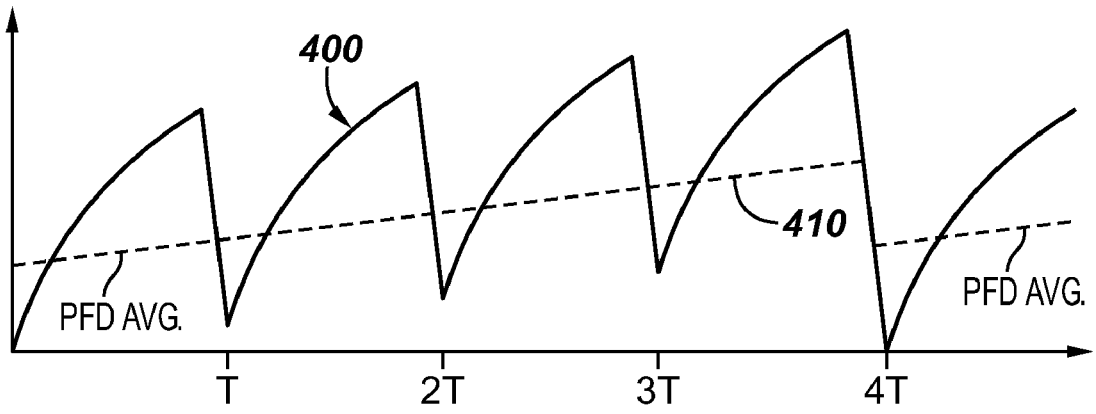
FIG. 4 is a graphical representation of the effect of periodic diagnostic tests on a probability of failure on demand levels of a system in accordance with an embodiment of the invention.

For example, FIG. 4 graphically illustrates an example of a probability of failure on demand of a system 118 over time.

Curve 400 is the PFD of system 118 over time, each time point identified at T, represents a point in time at which a diagnostic test is performed. Line 410 illustrates the increasing PFD average over time. Point 4T represents a time at which system 118 was renewed (e.g., repair, replacement, etc.) whether on a regular schedule or due to a realized need.

Safety shut-in system 118 is adapted to be a "failsafe" system such that a failure of control system 118, including subsurface control system 10, leaves subsea tree 120 in a safe state. An intended design constraint of subsea tree control systems is that the system must electrically fail "as-is." This is due to the potentially dangerous nature of spontaneously triggering subsea safety valves during rig operations. This issue has the potential to nullify the SIL rating of the system. Safety shut-in system 112 may utilize one or more of the following methods and systems to provide a failsafe system.

System 118 includes a time-delay included in the control and monitoring instructions of topside master control station 5 upon loss of main AC power (e.g., located at station 5). For example, as opposed to instructing system 118 to close subsea safety valves upon loss of main electrical power automatically, and autonomously, a time delay is utilized.

If the main electrical supply (e.g., from topside station 5) is discontinued for any reason, an alarm may sound periodically (e.g., every minute) and all operator interfaces indicate a power failure for a period of time (e.g., one hour). During this time delay system 118, including subsea tree control system 10, is maintained operational via an uninterruptible power source (e.g., located at topside station 5 or subsea control system 10 module). After the selected time-delay has elapsed, system 118 triggers all subsea valves to their "safe" position if the main power has not been restored. For example, in some embodiments the uninterruptible power source may maintain system 118 as if no failure had occurred, until battery power is exhausted, at which time the system may fail as-is. To prevent system 118 from failing as-is, master control station 5 may time the main power source outage, and after a set time without main power, automatically drive system 118 into the safe state. In one embodiment, the safe state includes topside and subsea portions of the well being isolated and the safety valves closed. For example, valve 128 and 130 may be closed. In some examples, latch 126 may be activated and tree 120 may be disconnected.

Safety shut-in system 118 includes redundant failsafe functions in some embodiments. When calculating the probability of failure on demand for two systems in parallel, the reliability figures can be multiplied together in order to obtain a significantly lower net number. To this end, the electrical failsafe also triggers a secondary parallel failsafe system that closes subsea tree 120 into the safe state by way of hydraulic actuation and spring-return of directional safety valves.

After system 118 fails into a safe position (e.g., safe state); a secondary safety system may reinforce the failsafe position. For example, a signal may be sent to a block-and-bleed valve on the hydraulic power unit, which is generally described as an element of topside master control station 5, causing umbilical 136 to loose its hydraulic pressure supply. The subsea control valves may be set to spring return to their safe position when the pressure supply is lost, thus channeling hydraulic energy stored in accumulator banks (e.g., subsurface control system 10) to close all safety valves to their safe state. Since this happens in parallel to the other actuation methodology, the PFD of this failsafe can be multiplied with the PFD of the standard failsafe resulting in a much lower net PFD.

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method for limiting the probability of failure on demand of a subsea test tree ("SSTT"), comprising:

utilizing a safety shut-in system comprising a surface control station positioned above a water surface and connected via an umbilical to a subsea control system positioned below the water surface and operationally connected to the SSTT to actuate a safety valve of the SSTT in response to a signal received from the surface control station;

transmitting an electric current to the subsea control system that is insufficient to actuate the safety valve;

calculating the implied impedance to the electric current; and determining if a fault mode of the SSTT has occurred.

2. The method of claim 1, wherein the subsea control system does not include a microprocessor.

3. The method of claim 1, comprising actuating the safety valve via DC actuation.

4. The method of claim 1, comprising maintaining the safety valve in an as-is position for a selected time delay upon electric failure of the safety shut-in system.

5. The method of claim 4, comprising actuating the safety valve to a safe state upon passage of the selected time delay.

6. The method of claim 4, wherein the subsea control system does not include a microprocessor.

7. The method of claim 4, comprising actuating the safety valve via DC actuation.

8. The method of claim 3, wherein the subsea control system does not include a microprocessor.

9. The method of claim 1, comprising demultiplexing the electric current below the water surface.

10. The method of claim 9, wherein the subsea control system comprises a diode steering circuit for the demultiplexing the electric current.

11. The method of claim 4, comprising demultiplexing the electric current below the water surface.

12. The method of claim 11, wherein the subsea control system comprises a diode steering circuit for the demultiplexing the electric current.

13. A method for limiting the probability of failure on demand of a subsea test tree ("SSTT"), comprising:

utilizing a safety shut-in system comprising a surface control station positioned above a water surface and a subsea control system positioned below the water surface and operationally connected to the SSTT to actuate a safety valve of the SSTT in response to a signal from the surface control system;

diagnostically testing the safety shut-in system without actuating the safety valve; and maintaining the safety valve in an as-is position for a selected time delay upon electric failure of the safety shut-in system.

14. The method of claim 13, comprising actuating the safety valve to a safe state upon passage of the selected time delay.

15. The method of claim 13, wherein the subsea control system does not include a microprocessor.

16. The method of claim 13, comprising actuating the safety valve via DC actuation.

17. The method of claim 16, wherein the subsea control system does not include a microprocessor.

18. The method of claim 13, comprising demultiplexing the electric current below the water surface.

19. The method of claim 18, wherein the subsea control system comprises a diode steering circuit for the demultiplexing the electric current.

20. The method of claim 18, comprising actuating the safety valve to a safe state upon passage of the selected time delay.

* * * * *